US005405284A

United States Patent [19]

Brenner et al.

[11] Patent Number: 5,405,284

[45] Date of Patent: Apr. 11, 1995

[54] CENTRIFUGAL JET MACHINE

[75] Inventors: Peter Brenner; Dieter Dettwiler, both of Schaffhausen, Switzerland

[73] Assignee: Georg Fischer Giessereianlagen AG, Schaffhausen, Switzerland

[21] Appl. No.: 30,430

[22] PCT Filed: Jul. 29, 1992

[86] PCT No.: PCT/CH92/00158

§ 371 Date: Mar. 31, 1993

§ 102(e) Date: Mar. 31, 1993

[87] PCT Pub. No.: WO93/03888

PCT Pub. Date: Mar. 4, 1993

[30] Foreign Application Priority Data

Aug. 13, 1991 [CH] Switzerland ..... 02386/91

[51] Int. Cl.[6] ..... B24C 3/28

[52] U.S. Cl. ..... 451/86; 451/75; 451/326

[58] Field of Search ..... 51/422, 423, 417, 418, 51/163.1, 164.1, 164.5, 313, 317, 319; 451/85, 86, 80, 81, 326, 328, 330, 32, 36, 38

[56] References Cited

U.S. PATENT DOCUMENTS 2,254,219 9/1941 Hamren .
3,079,735 3/1963 Freeman ..... 51/163.1
3,815,287 6/1974 Walker ..... 51/422
4,368,599 1/1983 Hunziker ..... 51/418

FOREIGN PATENT DOCUMENTS 475954 6/1915 France ..... 51/422
664971 9/1938 Germany ..... 51/422
690938 5/1940 Germany .
2424086 11/1975 Germany .
2806238 8/1979 Germany ..... 51/164.1

OTHER PUBLICATIONS

"Pangborn Rotoblas-Rocker Barrels", Pangborn Corp., Bulletin 213, pp. 4–26.

*Primary Examiner*—Joseph M. Gorski
*Attorney, Agent, or Firm*—Bachman & LaPointe

[57] ABSTRACT

The drum (2) of a centrifugal jet machine is swivelable in an oscillating manner between two angular positions. The drum (2) has a curved base part (8) with plate-shaped parts (9, 10) which are fastened at both sides of the latter so as to be swivelable. These parts (9, 10) are guided in guide rails (15) by means of rollers (13). Depending on the swiveling movement of the drum (2), these parts (9, 10) are swiveled out so that, at a swivel angle of at least 180°, the casing opening (3) also changes in such a way that the centrifugal jets strike the goods to be cleaned also in the extreme outer angular positions.

5 Claims, 5 Drawing Sheets

CENTRIFUGAL JET MACHINE

BACKGROUND OF THE INVENTION

The invention concerns a centrifugal jet machine having a drum which is swiveable in an oscillating manner around its longitudinal axis and is provided with an upper casing opening along which centrifugal jet units are arranged in a stationary manner.

A centrifugal jet machine is known from DE-A1-2931578. The drum cross section of this centrifugal jet machine is constructed in such a way that a maximum swivel angle of 120° is possible.

This swivel angle is not sufficient for a faultless rolling over of the workpieces to be treated and a jet treatment is not effected uniformly on all sides.

If the swivel angle is increased, the degree to which the drum can be filled must be reduced or the workpieces will fall out of the opening of the drum.

An attempt is made in the centrifugal machine shown in DE-A1-3210699 to increase the swivel angle by additional swiveling capacity of the centrifugal jet units. However, this requires a high construction cost with a synchronous control of the two swiveling movements. A maximum swiveling angle of 150° can be achieved in this way due to the required opening distance of the upper drum opening.

The object of the present invention is to provide a centrifugal jet machine of the type indicated in the beginning which has the high swiveling range required for faultless rolling and for a good filling level.

SUMMARY OF THE INVENTION

The present invention is a centrifugal jet machine comprised of a drum defining a chamber disposed along a longitudinal axis. The drum includes an upper opening communicating with the chamber; a curved base member which is rotatably movable about the longitudinal axis, wherein the base member has circumferential ends; and a least a first set and a second set of side parts, wherein each side part has two ends and each side part of the second set is pivotally connected to one of the circumferential ends of the base member and each side part of the first set is pivotally connected to a side part of the second set. The machine also includes means for oscillating the drum; a plurality of stationary jet units arranged along the upper opening of the drum in communication with the upper opening; and guide means for guiding the first and second sets of side parts. The guide means is positioned substantially adjacent each side of the drum and at least the first set of side parts pivotally engage the guide means.

The invention is shown in the attached drawings in a number of embodiment examples and is explained in the following.

DETAILED DESCRIPTION OF THE PREFERRED EMBODIMENTS

Figure 1:
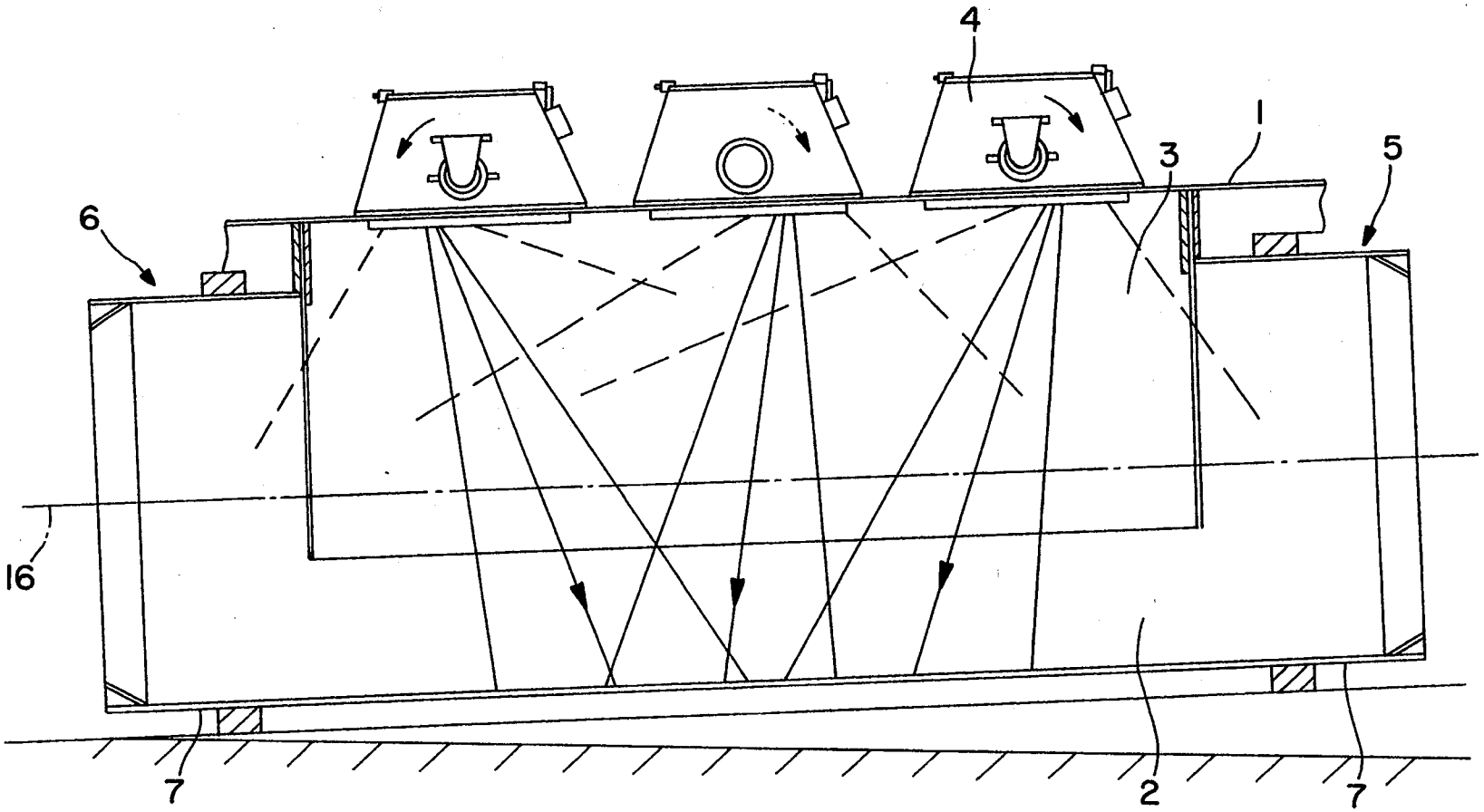
FIG. 1 shows a longitudinal section of a continuous-flow centrifugal jet machine.

FIG. 1 shows a continuous-flow centrifugal jet machine with a drum 2 which is arranged in a housing 1 so as to be inclined in the through-flow direction of the objects to be cleaned.

The drum 2 has an upper opening 3 in its casing. Centrifugal wheel units 4 which are fastened at the housing are arranged over this opening 3.

The drum 2 can be driven in an oscillating manner by means of a drive, not shown in more detail, so as to be swivelable between two angular positions.

Figure 2A:
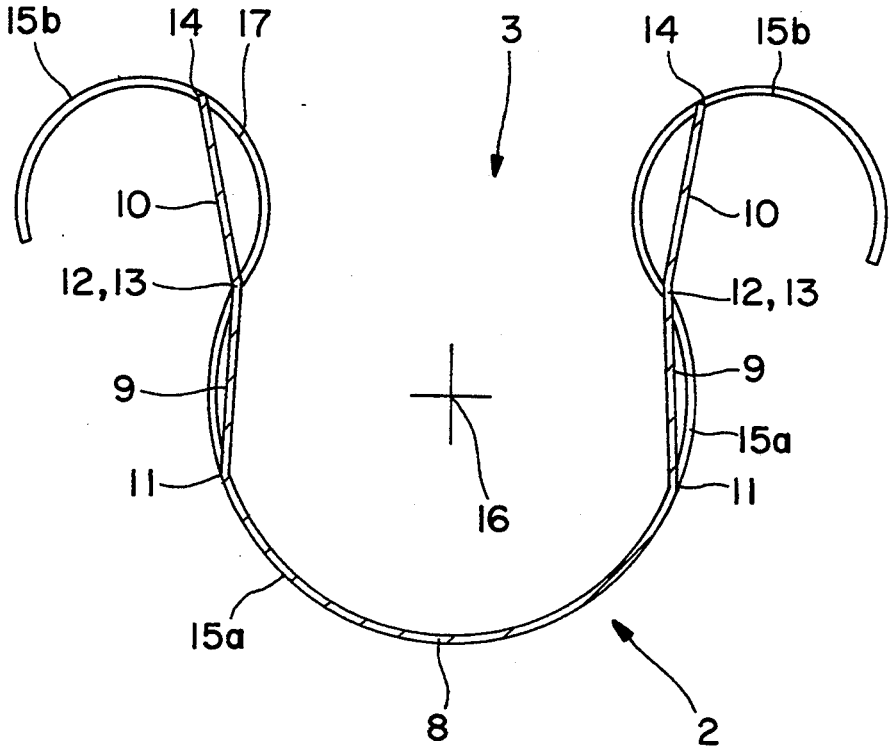
FIG. 2A shows a cross section of FIG. 1 schematically in the center position.
Figure 2B:
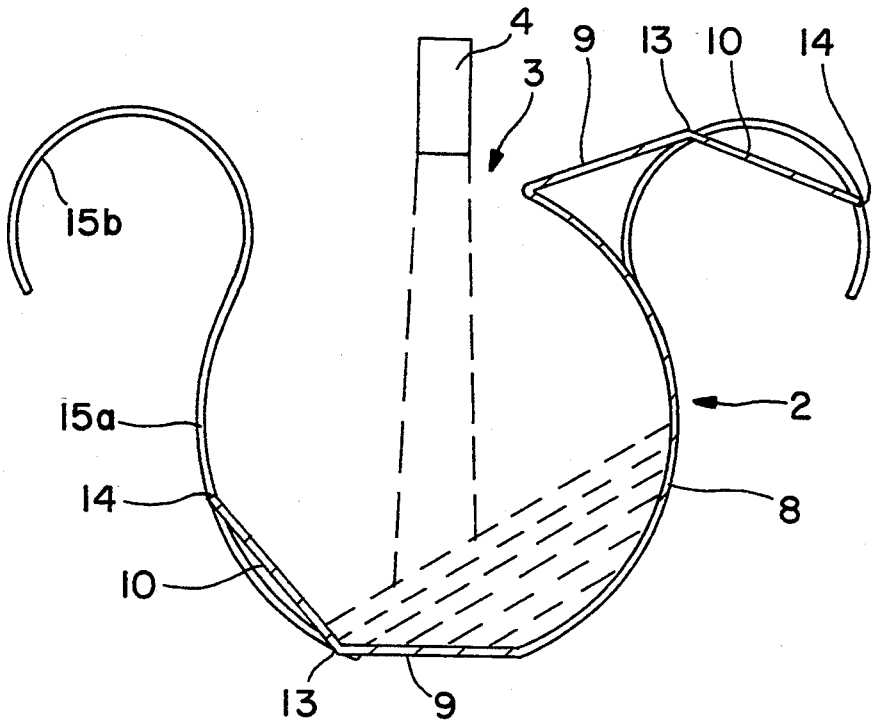
FIG. 2B shows a cross section corresponding to FIG. 2A in an outer angular position.

In the inlet region 5 and outlet region 6, the drum has a circumferentially closed casing 7. FIG. 2A shows a cross section of the drum 2 in the region of the casing opening 3 in the center position of the swiveling area and FIG. 2B shows another angular position.

The drum 2 has a curved base part 8. Two plate-shaped, hinged parts 9, 10 are arranged at the two circumferential ends of the base part 8 so as to swivel by means of joints 11 and 12. Rollers 13 and 14 are arranged at the joint 12 and at the circumferential end of the part 10 at both longitudinal ends and lie in grooves 17 of stationary guide rails 15. Each of the four guide rails 15 has a first curved part 15*a* which extends centrically relative to the drum axis 16 and a second curved part 15*b* which is directed outward away from the first part 15*a*.

Depending on the swiveling movement of the drum 2, the parts 9 and 10 of one side or the other are swiveled out (see FIG. 2B) so as to be guided by the rollers 13, 14 in the part 15*b* of the guide rail 15 so that a corresponding position of the casing opening 3 is provided for the entry of the centrifugal jets of the stationary centrifugal wheel units 4 in spite of the large swivel angle. In so doing, a sufficient casing wall for a good filling degree of the drum 2 is provided on the other side by the plate-shaped parts 9 and 10 which are guided in the part 15*a* of the guide rail 15.

A swivel angle of at least 180° can be achieved by means of this drum construction so as to ensure a faultless turning over of the objects to be cleaned.

Figure 3:
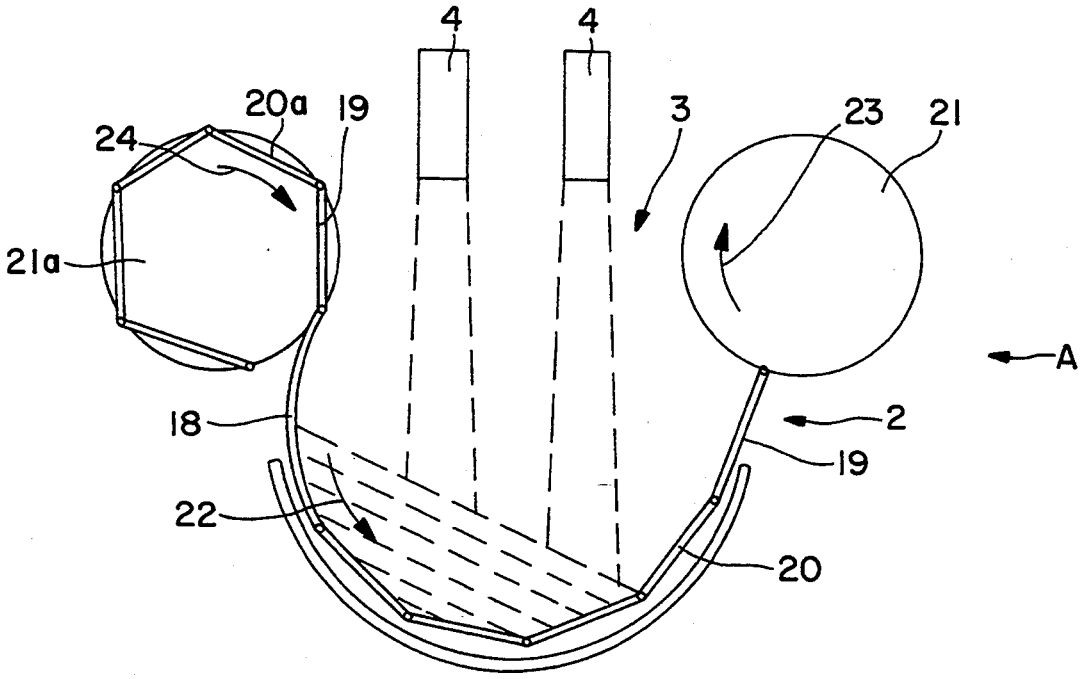
FIG. 3 shows a cross section of a constructional variant of a swivel drum schematically.

FIG. 3 shows a constructional variant of the drum 2 with a curved casing part 18, a plurality of plate-shaped members 19, preferably five, in the form of a chain 20, 20*a* being arranged at the circumferential ends of the casing part 18.

The ends of the chain 20, 20*a* are connected with drive pulleys or disks 21, 21*a* which are arranged in the upper region at the sides of the drum 2.

The drive disks 21, 21*a* are drivable in one rotating direction synchronously with the swiveling movement of the drum 2 and are freewheeling for rotation in the other direction.

FIG. 3 shows the drum 2 in an outer angular position. The drum 2 is then swiveled from this position in the direction of arrow 22 into the other angular position, wherein the drive disk 21 is driven synchronously relative to the drum movement in the direction of arrow 23.

The links 19 of the chain 20 are accordingly wound onto the drive disk 21. In so doing, the drive disk 21*a* rotates in the direction of arrow 24 due to the installed freewheel. When swiveling back in the opposite direction of arrows 22, 23 and 24, the drive disk 21*a* is driven synchronously with the drum 2.

This drum construction likewise ensures a swiveling angle of at least 180°. The casing opening 3 is always positioned with respect to the drum axis in such a way that at least two centrifugal wheel units 4 can be arranged adjacent to one another.

Figure 4:
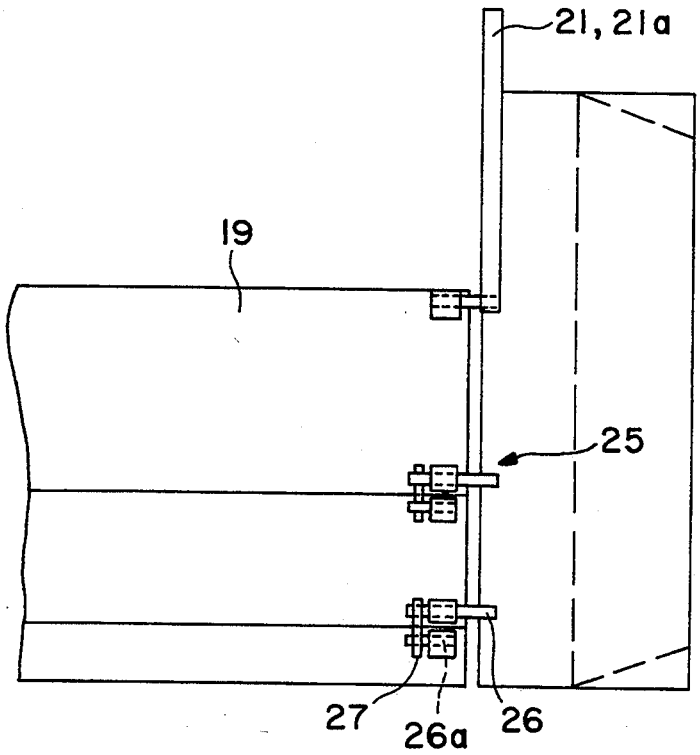
FIG. 4 shows a plan view in direction A of FIG. 3.

FIG. 4 shows the articulated connection 25 of the links 19, wherein pins 26, 26*a* which are fastened to the links 19 are connected by means of a bracket 27.

The prolongation of the pins 26 of the articulated connection 25 serves to guide and support the links at the outer circumference of the inlet and outlet drum and at the outer circumference of the drive disks 21 and 21*a*.

Figure 5A:
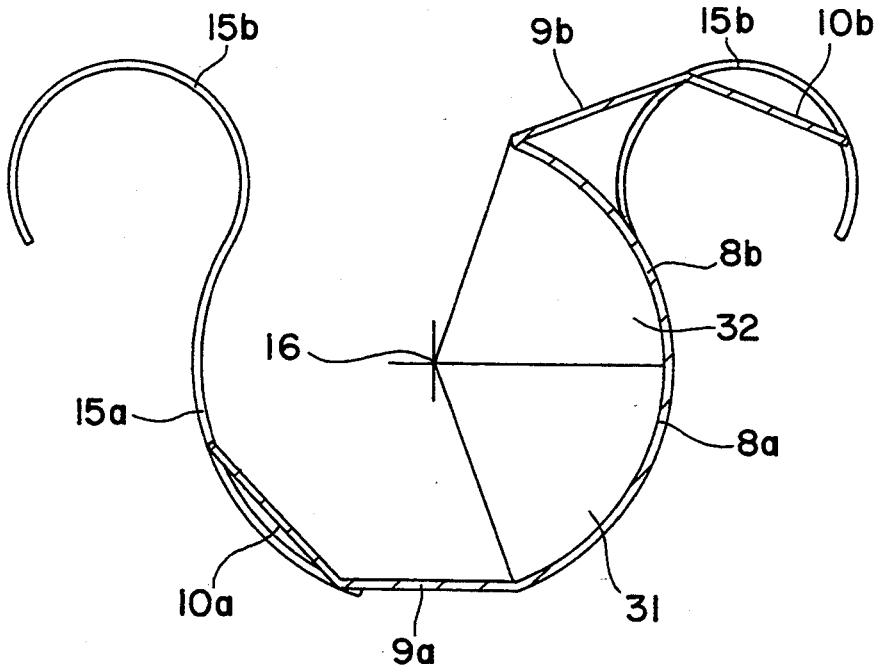
FIG. 5A shows a cross section of a batch swivel drum schematically in an outer angular position.
Figure 5B:
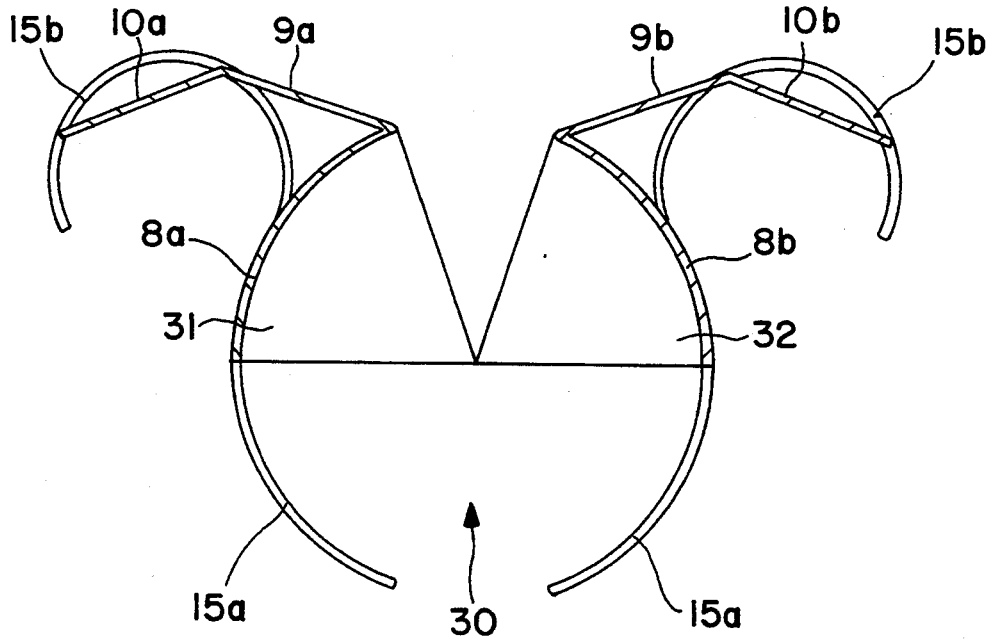
FIG. 5B shows a cross section corresponding to FIG. 5A in the emptying position.

FIGS. 5A nd 5B show schematic cross sections of a drum 2 which corresponds to the drum shown in FIGS. 2A and 2B, but is constructed for batch operation. For this purpose, the drum axis 16 is arranged horizontally and the goods to be cleaned are inserted laterally from the top when the drum is in a position corresponding to FIG. 5A. To empty the drum 2 downward, an outlet opening 30 must be formed in an emptying position according to FIG. 5B.

The drum casing is divided into two parts 31 and 32 by dividing the base part 8 into two halves 8*a* and 8*b*.

Part 31 includes the base part 8*a* and the plate-shaped parts 9*a* and 10*a*. Part 32 includes the base part 8*b* and the plate-shaped parts 9*b* and 10*b*. The two base parts 8*a* and 8*b* contact one another securely in the filling position and in swiveling operation and the drum parts 31 and 32 are moved jointly. For the purpose of emptying, the two parts 31 and 32 are driven separately proceeding from a central position (corresponding to FIG. 2A) in such a way that the opening 30 is formed according to FIG. 5B. It is not absolutely necessary that the parts 31, 32 be moved all the way into the two extreme outer angular positions according to FIG. 5B, since an emptying opening is already formed at a smaller angular position.

The drive for the two drum parts 31, 32, which is not shown in more detail, can be effected as follows. A swivel drive is in a working connection with the drum part 31 at one side of the drum. An emptying and closing drive having an idling or standstill motor is in a working connection with the drum part 32 on the other side of the drum. During a swiveling movement, the standstill motor acts against the drive force of the swivel drive so that the base parts 8*a*, 8*b* always contact one another so as to be closed. To open the drum, the standstill motor is driven in the direction opposite the swivel drive so that the two drum parts 31, 32 move away from one another.

Figure 6:
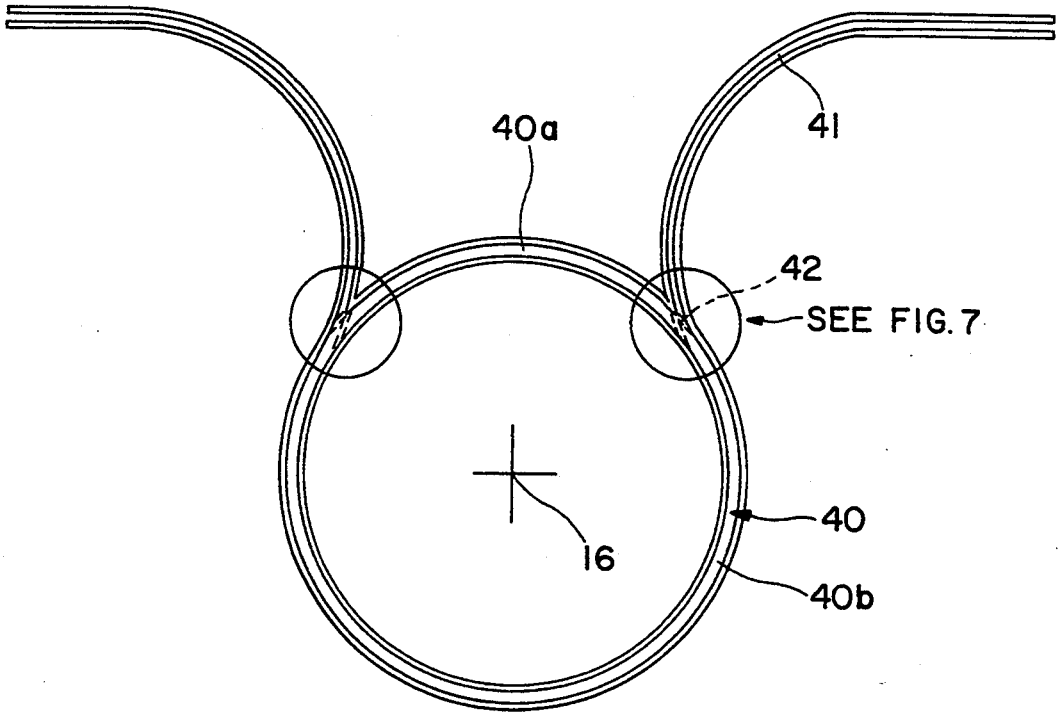
FIG. 6 shows the construction of a guide rail in a constructional variant of a batch swivel drum schematically.
Figure 7:
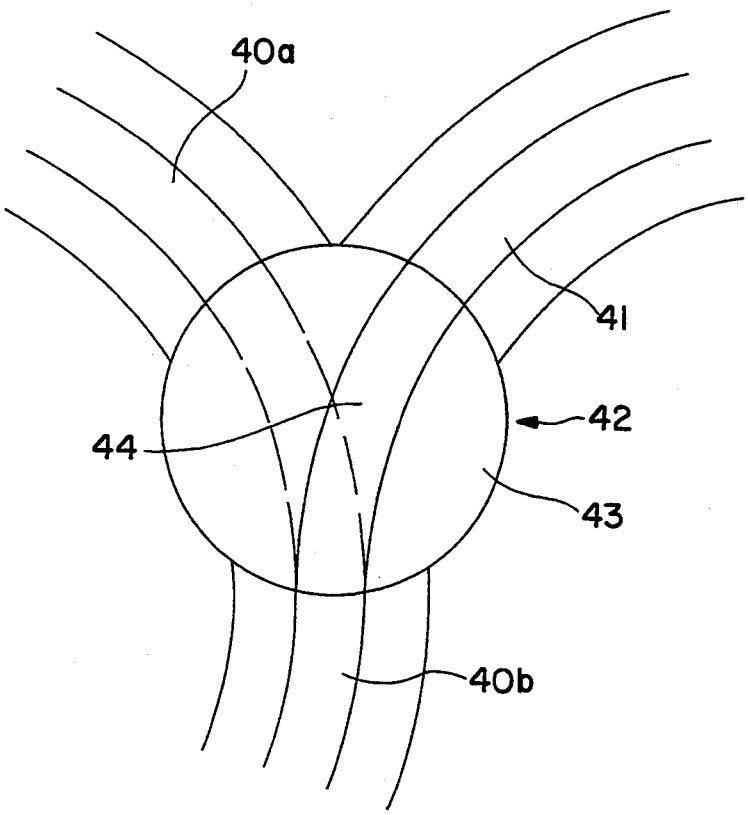
FIG. 7 is an enlarged view of detail B of FIG. 7.

FIGS. 6 and 7 show a different construction of the guide rails for another constructional variant of a drum for a batch-type centrifugal jet machine. In order to empty the drum, the latter is swivelable by 180° from a center position according to FIG. 2A and the goods to be cleaned are poured down into a container through the casing opening 3.

This is made possible in that circular guide rails 40 are arranged so as to be stationary at the both ends of the drum centrically relative to the axis 16 of the latter according to FIGS. 6 and 7. These guide rails 40 can engage in a working connection with two lateral guide rails 41 via switches 42. The switch 42 has a disk 43 which is swivelable around an axis, a curved groove 44 being arranged in this disk 43. The groove has the same radius as the guide rail 40. The guide rail 41 must also have the same radius where it connects to the switch 42. This radius then becomes smaller, possibly passing into a straight part of the guide rail 41 subsequently.

For the purpose of filling and for the jet treatment, in which the drum swivels between two angular positions, the switch 42 is positioned in such a way that the plate-shaped parts 9 and 10 of the drum casing are swiveled out by means of the guide rails 41 as is also shown in FIG. 2B, i.e. the guide rail 40 is connected with the guide rails 41 by the switches 42.

For the purpose of emptying, the disks 43 of the switches 42 are rotated in such a way that the upper part 40*a* of the guide rail 40 is connected with the lower part 40*b*. In this position, a complete rotation of the drum is possible so that the casing opening 3 can be swiveled by 180° from the upper central position according to FIG. 2A into a lower central position.

What is claimed is:

1. A centrifugal jet machine, comprising:

a drum defining a chamber disposed along a longitudinal axis, the drum having an upper opening communicating with the chamber, a curved base member which is rotatably movable about the longitudinal axis, the base member having circumferential ends located substantially symmetrically respective to the longitudinal axis, and at least a first set and a second set of side parts, wherein each side part has two ends and each side part of the second set is pivotally connected to one of the circumferential ends of the base member and each side part of the first set is pivotally connected to a side part of the second set;

means for oscillating the drum;

a plurality of stationary jet units arranged along the upper opening of the drum in communication with the upper opening; and substantially S-shaped guide means for guiding the first and second sets of side parts away from the chamber in an outwardly path relative the jet units and at least the first set of side parts in a downwardly path relative the jet units during the oscillation of the drum about the longitudinal axis, wherein the substantially S-shaped guide means is positioned substantially adjacent each side of the drum and the first set and the second set of side parts slidably engage the guide means, whereby the side parts travel along the path formed by the guide means allowing for a oscillation angle of the drum of at least 180° while maintaining unrestricted fluid communication between the jet units and the upper opening of the drum.

2. The centrifugal jet machine according to claim 1, wherein both ends of each side part of the first set are slidably connected with the guide means and at least one end of each of the side parts of the second set are slidably connected with the guide means.

3. The centrifugal jet machine according to claim 2, wherein the side parts are formed from substantially planar plates.

4. The centrifugal jet machine according to claim 1, wherein the drum can be moved into a charging and emptying position for batch operation and the base member comprises two movable curved parts, each curved part adapted to be moved away from the other to achieve the emptying position and form an outlet, the curved parts adapted to be moved via a drive.

5. The centrifugal jet machine according to claim 1, wherein the longitudinal axis of the drum is inclined in a through-flow direction for forming a continuous flow machine.

* * * * *